US006047708A

United States Patent [19]

Panel et al.

[11] Patent Number: 6,047,708

[45] Date of Patent: Apr. 11, 2000

[54] KIT AND PROCESS FOR CREATING A HAIR BUN

[76] Inventors: Sherelle L. Panel, 2554 Lincoln Blvd., Marina Del Rey, Calif. 90291; Tamara Pijeaux, 634 Stonecreek Wy., Stone Mountain, Ga. 30087

[21] Appl. No.: 09/293,202

[22] Filed: Apr. 16, 1999

Related U.S. Application Data

[60] Provisional application No. 60/082,282, Apr. 20, 1998.

[51] Int. Cl.[7] ..... A45D 8/04; A45D 8/12; A45D 24/00

[52] U.S. Cl. ..... 132/273; 132/200; 132/275

[58] Field of Search ..... 132/273, 274, 132/275, 245, 276, 56, 246, 248, 200, 207, 210, 54, 55

[56] References Cited

U.S. PATENT DOCUMENTS

| | | | |
|---|---|---|---|
| D. 292,030 | 9/1987 | Revson | D11/2 |
| 3,099,271 | 7/1963 | Dubelier | 132/275 |
| 3,301,266 | 1/1967 | Hoffman | 132/275 |
| 5,044,385 | 9/1991 | Rhoades | 132/275 |
| 5,156,171 | 10/1992 | Goodman | 132/200 |
| 5,417,230 | 5/1995 | Wood | 132/212 |
| 5,494,059 | 2/1996 | Barrows et al. | 132/273 |
| 5,769,101 | 6/1998 | Iwata | 132/273 |
| 5,890,494 | 4/1999 | Sonstegrard | 132/273 |

*Primary Examiner*—John J. Wilson
*Assistant Examiner*—Robyn K Doan
*Attorney, Agent, or Firm*—Albert O. Cota

[57] ABSTRACT

A hair bun kit (10) and process which allows a hair bun (60) to be easily and quickly formed. The hair bun kit (10) consists of a first resilient hairband (12), a second resilient hairband (48) and a hairbun mold (20) having a centered opening (22), an upper surface (24) and a lower surface (26). An optional ornamental hairband (50) may also be included to enhance the aesthetics of the hair bun (60). To use the hair bun kit (10) the first resilient hairband (12) is tightly wrapped around a bundle (64) of hair strands (62). The secured hair bundle (64) is then inserted through the centered opening (22) and the hair strands (62) are draped over the upper surface (24) of the mold (20). The second resilient hairband (48) is placed over the draped hair strands (62) and around the lower surface (26) of the hairbun mold (20) to secure the hair strands (62). The ornamental hairband (50) is then placed around the lower surface (26) of the hair bun mold to complete the hair bun (60).

6 Claims, 3 Drawing Sheets

KIT AND PROCESS FOR CREATING A HAIR BUN

This application claiming priority from the Provisional application Ser. No. 60/082,282 filed Apr. 20, 1998.

TECHNICAL FIELD

The invention pertains to the general field of hair accessories and more particularly to a kit which allows a hair bun to be quickly and easily formed.

BACKGROUND ART

Many people have sought to alter and improve their appearance by the use of physical adornments. One of the most popular methods by which people accomplish this is to adorn the face and head, and especially the hair. For ancient Egyptians a sign of prosperity or social importance was indicated by the intricate plaits in which their hair was placed. Often a cone of scented wax was placed on top of a person's plaited hair, and as the wax melted, the hair became perfumed with the scent.

In modern times the number of devices and accessories available for a person's hair have increased substantially. In addition to products that allow hair to be held in simple styles, such as a ponytail or pigtails, there are also products that allow hair to be easily and quickly placed in more complex holding styles. Although many of these products have greatly assisted hair styling there are still certain popular hair styles which require the assistance of a trained professional or, at the least, another person. One example of the more complex hair styles is a hair bun which often requires a certain amount of skill to accomplish correctly. A device or kit to easily create a hair bun would of great benefit for anyone who wants to style their hair in this manner.

A search of the prior art did not disclose any patents that read directly on the claims of the instant invention, however the following U.S. Patents are considered related:

PATENT NO. INVENTOR ISSUED 971,519 Brannen 4 Oct. 1910

2,668,547 Wille 21 Feb. 1952

Des. 292,030 Revson 22 Sep. 1987

The U.S. Pat. No. 971,519 Brannen patent discloses a hair accessory used to hold a bundle of hair which projects from the scalp, such as a pony tail. The hair holder consists of a flexible strip of material which includes a means for allowing the holder to be clamped around the bundle of hair.

The U.S. Pat. No. 2,668,547 discloses a hair accessory used to hold a bundle of hair which projects from the scalp. The hair holder can be used as a concealed clamping device or as an exposed device implemented with a snap action which affects the circumferential portion of the device without changing position. The hair accessory is constructed of a bell shaped structure of woven in elastic filament fibers arranged in curved strands and cross woven into a mesh.

The Des. Pat. No. 292,030 discloses a hair band having an internal elastic ring band that is covered with a gathered cloth. The hair band is typically used to hold hair strands that are placed around and tucked under a ring that is used to create a hair bun.

For background purposes and as indicative of the art to which the invention is related reference may be made to the remaining cited patents.

PATENT NO. INVENTOR ISSUED 537,542 Moore 16 Apr. 1895

2,805,673 Solomon 4 May 1953

3,099,271 Dubelier 30 Jun. 1963

3,301,266 Hoffmann 31 Jan. 1967

Des. 158,103 Kuenstner 11 Apr. 1950

Des. 167,553 Behr 26 Aug. 1952

Des. 221,115 Solomon 6 Jul. 1971

DISCLOSURE OF THE INVENTION

The hair bun kit is designed to allow a single person to quickly and easily form a symmetrical hair bun on the top, back or sides of the hair. To suit the individual's taste one or more buns can be formed to satisfy a particular style or unique hair dress. In its basic form, the hair bun kit consists of three implements.

a) a means for securing adjacent the scalp a hair bundle, wherein the center of the secured hair bundle is positioned where the center of the hair bun is to be located, b) a hairbun mold having an opening, an upper surface, and a lower surface. Through the opening is inserted the secured hair bundle with the hair strands distributed around and draped over the upper surface of the hairbun mold, and c) a means for securing the hair strands distributed and draped over the upper surface of the hairbun mold to the lower surface of the hair bunmold.

The means for securing the hair bundle consists of a first resilient hairband that is tightly wrapped around the hair bundle adjacent the scalp. Typically, the hairband has a thickness of 0.0625 inches (0.159 cm) and a diameter of approximately 2 inches (5.08 cm) with these dimensions the first resilient hairband can be easily manipulated to provide a tight grasp on the hair bundle.

The hair bun mold can be made in either a circular shape, an oval shape or even in a square shape. In all the designs, the hairbun mold has a centered opening, a circular cross section and can be dimensioned to form a hair bun ranging from 2 inches (5.08 cm) to 5 inches (12.7 cm). The mold is preferably made of a resilient material such as rubber or a soft plastic. However, a non-resilient material such as wood or a hard plastic can also be used. Additionally, the mold can be covered in a cloth such as satin or silk. The cloth covering prevents hair breakage and allows the hair strands to easily slide and controlled during the hair bun forming process.

The means for securing the hair strands distributed and draped over the hairbun mold consists of a second resilient hairband which is similar in construction to the first resilient hair band but having a larger diameter. Any hair strands that remain extended outward from the hairbun mold are tucked under the hairbun mold and the second resilient hairband. At this point in the process the hair bun has been completed. However, to add to the aesthetics of the hair bun an ornamental hairband can be attached around the lower surface of the hairbun mold.

In view of the above disclosure it is the primary object of the invention to provide a set of three implements that in combination allows an individual to easily and quickly form a hair bun.

In addition to the primary object of the invention it is also an object of the invention to provide a hair bun kit and process that:

can be used by most anyone, utilizes a process that is easily mastered, assures a symmetrical and an aesthetic hair bun, has a long useful life, and is cost effective from both consumer and manufacturing points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a hair bun kit 10 and a process which allows an individual to form a hair bun 60. The hair bun 60 may be formed on the top, back or sides of a person's head.

Figure 1:
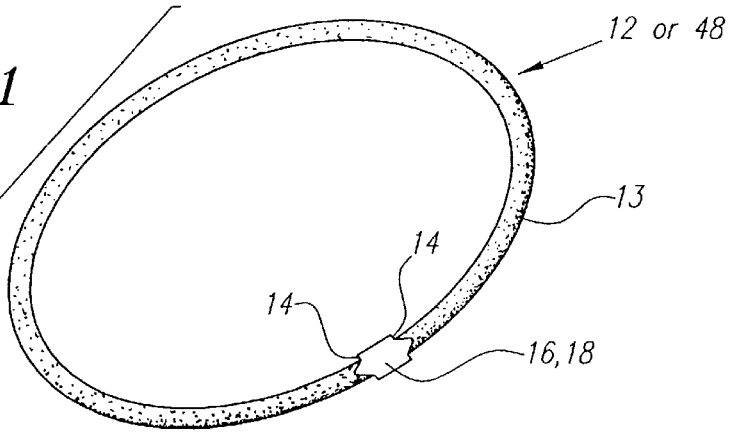
FIG. 1 is a perspective view of the first and second resilient hairbands.
Figure 2:
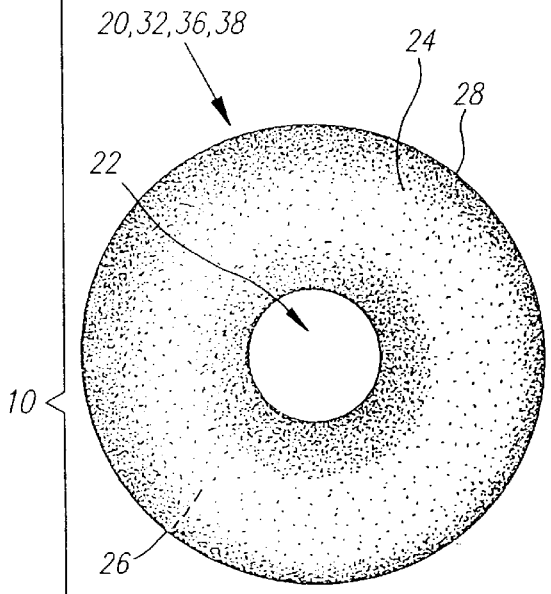
FIG. 2 is a top plan view of a circular hairbun mold.
Figure 3:
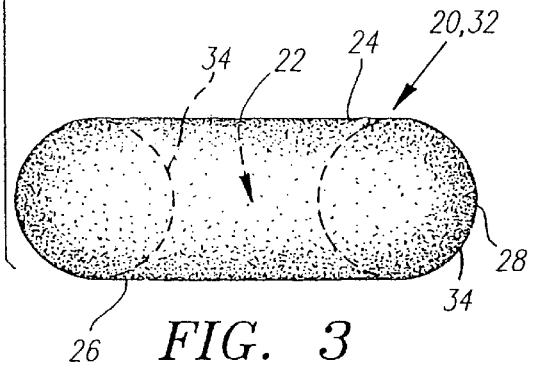
FIG. 3 is a side elevational view of the circular hairbun mold shown in FIG. 2.
Figure 5:
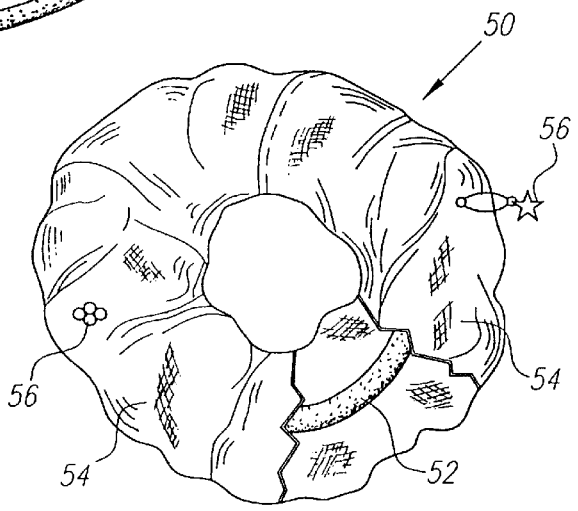
FIG. 5 is a top plan view and partial sectional view of the ornamental hairband showing an inner resilient band covered with a gathered cloth material.
Figure 6:
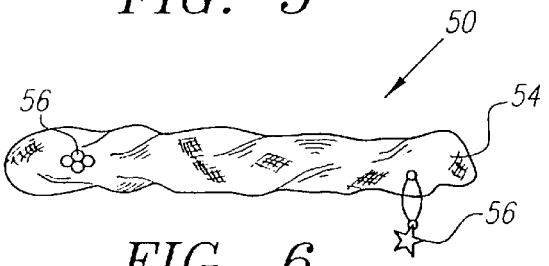
FIG. 6 is a side elevational view of the ornamental hairband shown in FIG. 5.
Figure 4:
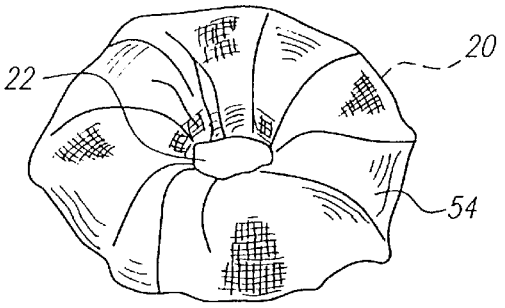
FIG. 4 is a perspective view of a hairbun mold covered with a cloth.

The hair bun kit 10, in its basic design, is shown in FIGS. 1, 2 and 3 and is comprised of three elements: a first resilient hairband 12, a hairbun mold 20 and a second resilient hairband 48. In addition to the three basic elements a cloth material 54 may be employed to cover the hairbun mold 20 as shown in FIG. 4, and an ornamental hair band 50, as shown in FIGS. 5 and 6, may be utilized to enhance the aesthetics of the completed hair bun 60. The hair bun kit 10 is used in combination with a multiplicity of hair strands 62 which evolve into a hair bundle 64. The process for creating the hair bun 60 is illustrated in FIGS. 7–12.

The first resilient hairband 12, as shown in FIG. 1, is made from a thin resilient band 13 that is attached at each end 14 with an attachment means 16. The band 13 has a thickness ranging from 0.0625-inches (0.159 cm) to 0.1875-inches (0.476 cm) and an outer diameter ranging from 1-inch (2.54 cm) to 2.5-inches (6.35 cm). The band diameter selected is dependent upon the thickness of the hair bundle 64 which ultimately is determined by the diameter of the hair bun 60 that is to be formed. The attachment means 16 can be comprised of a metal or plastic crimp 18, as also shown in FIG. 1, which holds the two ends 14 together.

The hairbun mold 20, which is considered to be the primary element of the hair bun kit 10, is shown in FIGS. 2 and 3. The hairbun mold 20 includes a substantially centered opening 22, an upper surface 24, a lower surface 26 and an outer circumference 28. The centered opening 22 is dimensioned to receive, commencing from the lower surface 26 of the hairbun mold 20, the hair bundle 64 which has been secured, near the scalp, by a tightly wrapped first resilient hairband 12. The hair bundle 64 extends through the upper surface of the hairbun mold 20 with the mold's lower surface 26 juxtaposed against the first resilient hairbun 12 and the scalp. The hair strands 62 projecting through the centered opening 22 of the hairbun mold 20 are then separated and draped around and over the entire upper surface 24 of the hairbun mold.

The hairbun mold 20 preferably has a substantially circular toroidal shape 32 with a substantially circular cross section 34 as shown in FIGS. 2 and 3. In this preferred configuration, the hairbun mold 20 has a circular cross section that ranges from 0.5-inches (1.27 cm) to 1.25-inches (3.175 cm) and an outer diameter that ranges from 2-inches (5.08 cm) to 5-inches (12.7 cm). Although a toroidal shape is preferred, the hairbun mold can also be made in an oval shape (not shown) with a substantially circular cross section or even in a square shape (not shown) also with a substantially circular cross section. In all the shapes, the hair- bun mold 20 is preferably made from a resilient material 36 such as rubber, a soft plastic or a foam. Alternatively, the hairbun mold 20 can also be made of non-resilient material 38 such as wood or a hard plastic.

As shown in FIG. 4, the hairbun mold 20 can be covered with a cloth material 54 such as satin or silk. The cloth covering serves three purposes, it can be made in a color that compliment and enhances the color of the hair, prevents hair breakage and also functions by allowing the hair strands 62 to easily slide and be controlled during the hair bun forming process as described infra.

The third element of the hair bun kit 10 is the second resilient hairband 48 which is similar to the first resilient hair band 12 as shown in FIG. 1. The second resilient hairband 48 is tightly placed over the separated and draped hair strands 62 and around the lower surface 26 of the hairbun mold 20 to secure most of the hair strands 62 to the mold 20. Any remaining hair strands 62 that extend outward from the hairbun mold 20 are tucked under the lower surface 26 of the mold 20 and the second resilient hairband 48.

The final element that can be used to further enhance the aesthetics of the hair bun 60 is the ornamental hairband 50 as shown in FIGS. 5 and 6. The hairband 50, as shown in FIG. 5 is comprised of an inner resilient band 52 that is covered with a gathered cloth material 54 which can also consist of satin, silk or cotton. The cloth material 54 can be colored in a color that compliments the hair color and can be further embellished with various ornaments 56. After the hair bun 10 is formed as described infra, the ornamental hair band 50 is placed around the lower surface 26 of the hairbun mold 20.

Figure 7:
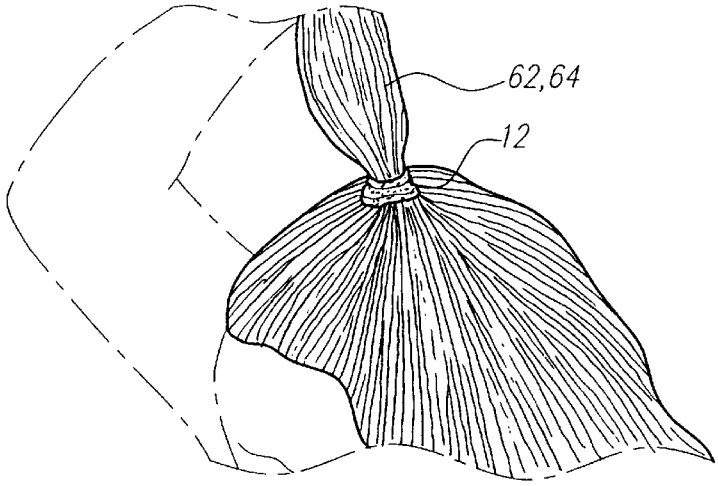
FIG. 7 is a perspective view of a hair strand bundle that has been secured with the first resilient hairband which corresponds to steps a) and b) of the process for forming a hair bun.
Figure 8:
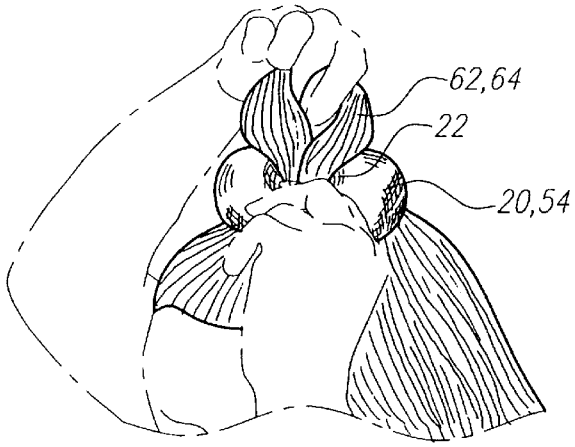
FIG. 8 is a perspective view of a hair strand bundle which has been inserted through the centered opening of the hairbun mold which corresponds to step c) of the process.
Figure 9:
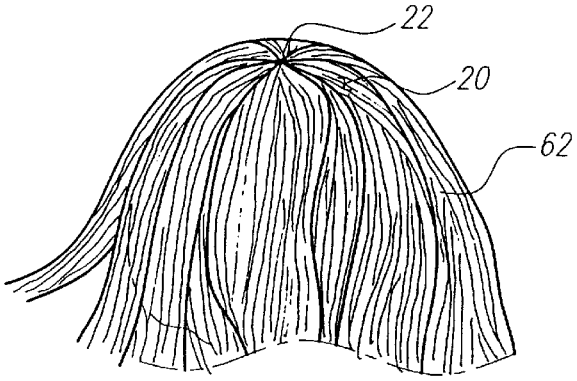
FIG. 9 is a perspective view showing the hair strands from the hair bundle projecting through the centered opening with the hair strands separated and draped over the upper surface of the hairbun mold which corresponds to step d) of the process.
Figure 10:
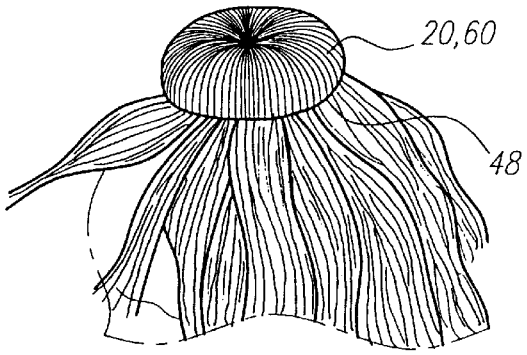
FIG. 10 is a perspective view showing the second resilient hairband placed over the draped hair strands and around the lower surface of the hairbun mold to secure most of the hair strands to the hairbun mold corresponding to Step e) of the process.
Figure 11:
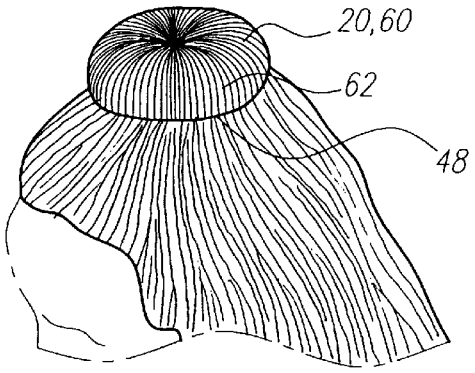
FIG. 11 is a perspective view showing the remaining hair strands extending outward tucked under the hairbun mold and the second elastic hairband corresponding to step f) of the process.
Figure 12:
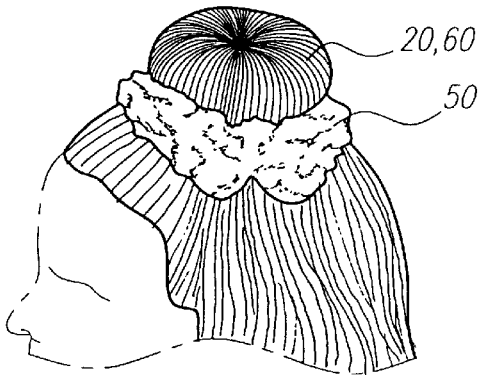
FIG. 12 is a perspective view showing the ornamental hairband attached around the lower surface of the hairbun mold.

The process for forming the hair bun 60 on the top, back or sides of a person's hair utilizing the first resilient hairband 12, the second resilient hairband 48, and the hairbun mold 20 which has a substantially centered opening 22, an upper surface 24, and a lower surface 26, is comprised of the following steps:

a) grasp a quantity of hair strands 62 and bring them inward to form a hair bundle 64 as shown in FIG. 7. The center of the hair bundle 64 is positioned where the center of the hair bun 60 is to be located, b) tightly grasp and secure the hair bundle 64 adjacent the scalp with the first resilient hairband 12 as shown in FIG. 7, c) insert the secured hair bundle 64 through the centered opening 22 on the hairbun mold 20 as shown in FIG. 8, d) allow the hair strands 62 from the hair bundle 64 projecting through the centered opening of the hairbun mold 20 to be separated and draped over the entire upper surface 24 of the hairbun mold 20 as shown in FIG. 9, e) place the second resilient hairband 48 over the separated and draped hair strands 62 and around the lower surface 26 adjacent the centered opening 22 of the hairbun mold 20 to secure most of the hair strands 62 to the hairbun mold 20 as shown in FIG. 10, and f) tuck any remaining hair strands 62 extending outward from the hairbun mold 20 under the hair bun mold 20 and the second elastic hairband 48 as shown in FIG. 11.

After the above process has been completed, the ornamental hairband 50 may be attached around the lower surface 26 of the hairbun mold 20. The addition of the ornamental hairband 50 completes the forming of the hair bun 60.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A kit for forming a hair bun on the top, back or sides of a person's hair, said kit comprising:

a) a first resilient hairband that is tightly wrapped around a hair bundle, wherein the center of the hair bundle, secured adjacent the scalp, is positioned where the center of the hair bun is to be located, b) a hairbun mold having a substantially toroidal shape with a substantially cross section, a centered opening, an upper surface, a lower surface, wherein the centered opening is dimensioned to receive from the lower surface of said hairbun mold the secured hair bundle which extends upwards through the upper surface with the lower surface of said hairbun mold juxtaposed against the first resilient hairband and the scalp, wherein the hair strands projecting through the centered opening of said hairbun mold are distributed and draped over and around the upper surface and outer circumference of said hairbun mold, and c) a second resilient hairband that is tightly placed over the separated and draped hair strands and around the lower surface of said hairbun mold to secure most of the hair strands to said hairbun mold, wherein to complete said hair bun, any remaining hair strands extending outward from said hairbun mold are tucked under said hairbun mold and under said second resilient hairband.

2. The kit as specified in claim 1 wherein said hairbun mold is made from a resilient material.

3. The kit as specified in claim 1 wherein said hairbun mold is covered with a cloth material such as satin or silk.

4. The kit as specified in claim 1 further comprising an ornamental hairband that is placed around the lower surface of said hairbun mold, wherein said ornamental hair band adds to the aesthetics of said hair bun.

5. A process for forming a hair bun on the top, back or sides of a person's hair utilizing a first resilient hairband, a second resilient hairband, and a hairbun mold having a substantially centered opening, an upper surface, and a lower surface, said process comprising the following steps:

a) grasp a quantity of hair strands and bring them inward to form a hair bundle, wherein the center of the hair bundle is positioned where the center of the hair bun is to be located, b) tightly grasp and secure the hair bundle adjacent the scalp with said first resilient hairband, c) insert the secured hair bundle through the centered opening on said hairbun mold, d) allow the hair strands from the hair bundle projecting through the centered opening of said hairbun mold to be distributed and draped over the upper surface of said hairbun mold, e) place said second resilient hairband over the draped hair strands and around the lower surface adjacent the centered opening of said hairbun mold to secure most of the hair strands to said hairbun mold, and f) tuck any remaining hair strands extending outward from said hairbun mold under said hairbun mold and said second resilient hairband.

6. The process as specified in claim 5 further comprising the step of attaching an ornamental hairband around the lower surface of said hairbun mold.

* * * * *